United States Patent [19]

Doni et al.

[11] Patent Number: 4,898,147

[45] Date of Patent: Feb. 6, 1990

[54] DOMESTIC OVEN OBSERVATION WINDOW HAVING A LOW TEMPERATURE EXTERNAL SURFACE

[75] Inventors: Fabrizio Doni; Bruno Ferrario, both of Milan, Italy

[73] Assignee: SAES Getters SpA, Milan, Italy

[21] Appl. No.: 266,151

[22] Filed: Nov. 2, 1988

[30] Foreign Application Priority Data

Nov. 24, 1987 [IT] Italy ..... 22735

[51] Int. Cl.[4] ..... F23M 7/00

[52] U.S. Cl. ..... 126/200; 126/190; 52/171; 52/172; 52/788

[58] Field of Search ..... 126/200, 190, 441, 443, 126/450; 110/180; 252/181, 181.6; 219/391, 392; 52/171, 172, 788, 479

[56] References Cited

U.S. PATENT DOCUMENTS

| | | | |
|---|---|---|---|
| 3,710,776 | 1/1973 | Frick | 126/200 |
| 3,926,832 | 1/1975 | Barosi | 252/181.6 |
| 4,142,509 | 3/1979 | Hermann et al. | 126/443 X |
| 4,183,351 | 1/1980 | Hinotani et al. | 126/443 |
| 4,312,669 | 1/1982 | Boffito et al. | 420/422 |
| 4,459,789 | 7/1984 | Ford | 52/171 X |
| 4,687,687 | 8/1987 | Terneu et al. | 52/171 X |

*Primary Examiner*—Larry Jones

*Attorney, Agent, or Firm*—David R. Murphy

[57] ABSTRACT

A window for a domestic oven is described which has a reduced thermal transmission so that the outer glass surface, which can be toughed, is maintained at an acceptable temperature. Between the surface of an outer glass sheet and an inner glass sheet of the window there is a rare gas filled enclosed volume. Preferably at least the inner facing surface of the outer glass sheet is coated with a transparent layer of reflecting material. A non-evaporable getter material is contained within said enclosed volume.

14 Claims, 1 Drawing Sheet

DOMESTIC OVEN OBSERVATION WINDOW HAVING A LOW TEMPERATURE EXTERNAL SURFACE

DESCRIPTION OF PRIOR ART

It is known that, in function of the temperature that is generated within a domestic oven, whether it is being operated by gas or by electricity, the external surface of the observation window of the oven may reach temperatures which are dangerous for the safety of people, and especially children, who may inadvertently touch said surfaces.

For example with an oven window consisting of two separate panels of glass separated by a metal frame, it is found that with an internal oven temperature of 250° C. the external surface of the outer window reaches a temperature of 130° C.

Up to the present moment there has been found no satisfactory solution to this problem which also maintains, at the same time, a good visibility of the inside of the oven. The use of thicker glass has not given hoped for results.

Neither would it be useful or advisable to adopt for this application the so called double glazing which consists of two sheets of glass joined together and which may have zeolite in the intermediate space for the sorption of humidity, as this type of construction is mainly used in the building industry etc. and does not appreciably reduce heat transmitted by radiation or conduction.

To solve the problem it has also been tried to protect the oven glass window with glass doors which protect against accidental direct contact, but this protection exists only until the moment in which the user, in order to observe inside the oven, or a third person such as a child, especially because of curiosity, opens the protective door.

If two glass sheets separated by an evacuated space were to be used as a vacuum insulator there would be the danger of an implosion if one of the glass sheets were to break for any accidental reason.

It is therefore an object of the present invention to provide a domestic oven window having a reduced thermal transmission and therefore an acceptable temperature on the external surface such as not to produce burns on accidental contact while at the same time providing good visibility of the inside of the oven.

It is another object of the present invention to provide a domestic oven window free from dangers of implosion.

These and other objects and advantages of the present invention will become evident from the following description and drawings wherein:

BRIEF DESCRIPTION OF THE INVENTION

The present invention provides an observation window comprising an inner and an outer glass sheet joined together by a peripheral distancing wall which define an enclosed volume containing a controlled pressure of rare gas. Furthermore the inner facing surface of the outer glass sheet is covered with a layer of material reflecting infrared radiation and transmitting visible light.

In one preferred embodiment the window is formed from a single piece of borosilicate glass such as Pyrex (registered trademark) and in a second preferred embodiment the two glass sheets are joined together by a distancing wall along the outer periphery using a vacuum sealing resin, capable of supporting the locally reached temperature, such as an epoxide resin.

DETAILED DESCRIPTION OF THE INVENTION

Figure 1:
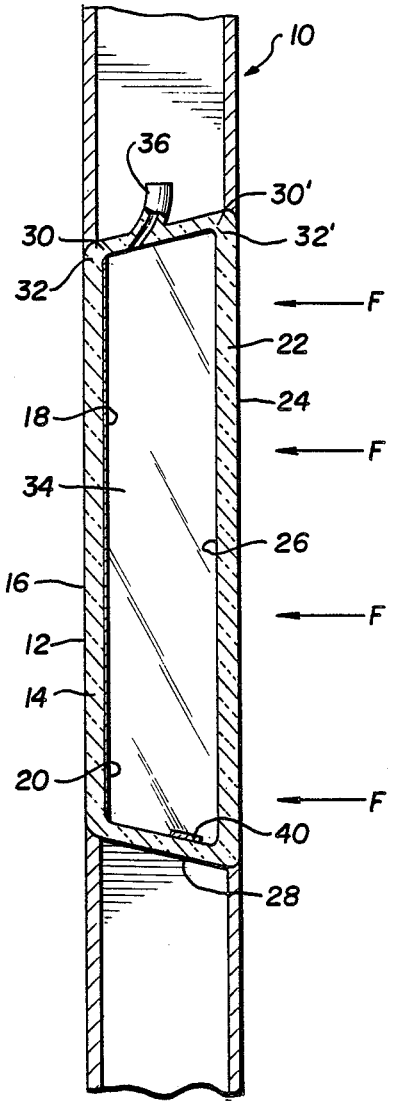
FIG. 1 is a cross-sectional representation of a domestic oven observation window according to the present invention.

Making reference now to FIG. 1 there is shown a domestic oven door 10 containing an observation window 12 comprising an outer glass sheet 14 which may be curved but is preferably substantially planar. The glass should be resistant to thermal shock and is therefore preferably of a borosilicate glass such as Pyrex. Sheet 14 has an outer facing surface 16 and an inner facing surface 18. Inner facing surface 18 is covered by at least one layer 20 of a material which reflects infrared radiation and transmits visible light. It is preferably a multilayer of metal oxides. Observation window 14 also comprises an inner glass sheet 22 which again is preferably substantially planar and of borosilicate glass. Glass sheet 22 has an outer facing surface 24 and an inner facing surface 26 which may, if desired be covered by at least one layer of a material which reflects infra-red radiation and transmits visible light. It is preferably a multilayer of metal oxides.

A distancing wall 28, preferably of borosilicate glass has edges 30, 30' which are attached to the peripheries 32, 32' of outer glass sheet 14 and inner glass sheet 22 respectively, thus defining an enclosed volume 34.

Distancing wall 28 is provided with a pumping tubulation 36, preferably of borosilicate glass which is used for initially evacuating enclosed volume 34 and then backfilling with a rare gas.

Figure 2:
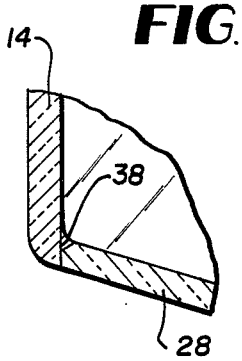
FIG. 2 is an enlarged detail of an alternative embodiment of the window.

Outer glass sheet 14, inner glass sheet 22 and distancing wall 28 together with tubulation 36 may be made from a single piece of glass by known glass blowing techniques. However it is conveniently made from two pieces. The first piece being outer glass sheet 14 and the second piece being a single piece comprising inner sheet 22 and distancing wall 28. FIG. 2 shows the bonding of sheet 14 to combined sheet 22 and wall 28 by means of a gas tight seal 38.

The seal 38 which is preferably on the outer wall which is at a lower temperature can be obtained for example by the use of a resin which can give a gas tight seal and that is resistant to heat such as an epoxy based resin, for example araldite, whose temperature of use reaches a maximum of about 120° -130° C.

Volume 34 is then evacuated through pumping tubulation 36 and then backfilled with a rare gas to a predetermined pressure where upon tubulation 36 is sealed-off. The rare gas may be He, Ne, Ar, Kr or Xe and is preferably Kr which proves to be the best compromise between cost and low thermal conductivity.

As the thermal conductivity of a gas is sensibly constant over a wide range of pressures the gas may be present in the pressure range of about 10 mbar to 1000 mbar at 25° C. However it is preferably present at approximately atmospheric pressure (about 1000 mbar) during operation of the oven in the range of about 100 to 250° C. Therefore the pressure of the rare-gas should be preferably between 700 to 900 mbar at 25° C.

During operation of the oven, the glass sheets are heated and are subject to the release of gases within the enclosed volume. These gases such as $H_2O$ and especially $H_2$ can considerably increase the thermal conductivity between the glass sheets leading to an increase in temperature of the outer surface of the outer glass sheet. To avoid this increase in temperature it is preferably to use a getter material within the enclosed volume to sorb these unwanted gases.

This is accomplished according to the invention, by means of a non-evaporable getter material 40 held in any known manner within the volume 34 in such a way as not to impede visual inspection through window 1O. It must above all sorb gases that are released because of the working temperature of the oven which determines the so called outgassing.

Figure 3:
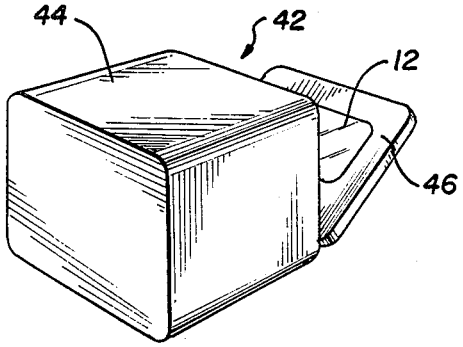
FIG. 3 is a representation of an oven having a door provided with a window of the present invention.

Referring now to FIG. 3 there is shown an oven 42 having an enclosure 44. A door 46 provides access to the enclosure 44. The oven 42 also has means (not shown) for heating the enclosure 44. The door 46 is provided with a window 12 of the present invention.

The getter material used is any non-evaporable material capable of sorbing permanently active gases and hydrogen reversibly. Preferably the non-evaporable getter material is chosen from the following:

(a) An alloy of zirconium and aluminium in which the weight % of aluminium is between 5 and 30%; such as described in U.S. Pat. No. 3,203,901;

(b) A partially sintered mixture of powdered graphite or zeolite with at least one metallic powder chosen from the group comprising Zr, Ta, Hf, Nb, Ti, Th and U, the powder of graphite or zeolite being present up to a weight % of 30%; such as described in U.S. Pat. No. 3,584,253;

(c) A partially sintered mixture of:

(i) particulate Zr-Al comprising from 5 to 30 weight % of Al, remainder Zr, and (ii) at least one metallic powder chosen from the group comprising Zr, Ta, Hf, Nb, Ti, Th and U; such as described in U.S. Pat. No. 3,926,832;

(d) A powdered alloy of Zr-V-Fe whose weight composition in weight % when plotted on a ternary composition diagram in weight % Zr, weight % V and weight % Fe lies within a polygon having as its corners the points defined by:

(i) 75% Zr - 20% V - 5% Fe (ii) 45% Zr - 20% V - 35% Fe (iii) 45% Zr - 50% V - 5% Fe; such as described in U.S. Pat. No. 4,312,669;

e) A partially sintered mixture of:

(i) particles of at least one metal chosen from the group comprising Ti and Zr, and (ii) a powder alloy Zr-V-Fe whose composition in weight % when plotted on a ternary composition diagram in weight % Zr, weight % V and weight % Fe lies within a polygon having As its corners the points defined by:

i - 75% Zr - 20% V - 5% Fe ii - 45% Zr - 20% V - 35% Fe iii - 45% Zr - 50% V - 5% Fe; such as described in UK Pat. No. 2,077,487.

The getter material can be positioned freely within space 14 in the form of pills or pellets or fixed in any known way in the form of powder compacted or pressure bonded onto a metallic support strip.

As can be better seen from the following examples it has been found that there is a drastic reduction in the heat transmission towards the exterior if on the internal surface of outer glass sheet 14 there is an infrared reflecting layer 20 which is also transparent to visible light. This layer can be of any known type for instance it may comprise various layers of oxides such as titanium silicon or copper oxides.

A further improvement of the results obtained concerning the aspect of transmission of heat towards the outside is represented in the FIG. 1 by arrows F coming from inside the oven (not shown) can be foreseen by the use of a similar reflecting layer on the innerfacing surface 26 of inner glass sheet 22.

The results obtained with an experimental set up designed to simulate the behaviour of a window according to the present invention are illustrated in the following examples.

EXAMPLE 1

Several Pyrex windows were manufactured which for easy of construction had a circular form and the front window was attached in a gas tight manner to the rest of the window by means of araldite. With respect to the previously described embodiment there was no internal reflecting layer 20. Furthermore in order to avoid reaching temperatures at which the use of the bonding agent cannot be guaranteed the temperature of the experiment was maintained at about 1OO° C., by heating to this temperature the inner glass sheet of the window. This simulates an internal temperature of the oven. The tests of thermal conductivity were conducted with the enclosed volume between the sheets in air obtaining the results in the following Table I.

TABLE I

| Internal Temperature (°C.) | External Temperature (°C.) | Thermal Flux ($W/m^2$) | Pressure |
|---|---|---|---|
| 98 | 57 | 440 | in air |

Analogous thermal measurements on a real oven displayed a behaviour similar to this for corresponding temperatures of about 1OO° C. on the internal part of the window with respect to devices used experimentally in air. For example for an oven temperature of 120° C. the internal window temperature is 1OO° C. and the external temperature of the window is 56° C. with a thermal flux of 450 $W/m^2$ (watts per square meter). This agreement between the measurements ensures that the results obtained with an experimental set-up are perfectly transferable to a real oven.

EXAMPLE 2

The importance of reflecting layer 20 is demonstrated in the following Example carried out as Example 1 on the same experimental set up as described which comprises this time the layer 20, still at a temperature of 100° C. on the internal face of the device, the enclosed volume being in air. The infrared reflecting layer comprises several layers of oxides, each one about 1 $\mu m$ thick. The respective results are given in following Table II.

TABLE II

| Internal Temperature (°C.) | External Temperature (°C.) | Thermal Flux ($W/m^2$) | Pressure |
|---|---|---|---|
| 100 | 44 | 230 | in air |

From a comparison of the previous results it is seen that the reflecting layer 20 gives a significant contribution in reducing the external temperature by about 23% and the thermal flux by about 48%.

EXAMPLE 3

As a consequence of the results obtained with previous Example 2 it was then possible to repeat the tests at real working temperatures of the window in a domestic oven without provoking damage to the characteristics of the resin seal as this seal will remain on the outer glass sheet at a temperature less than the critical temperature of 120–130° C. Therefore three additional tests were carried out all with the enclosed volume containing krypton at a pressure of 1O mbar and at temperatures of approximately 1OO°, 150° and 200° C. of the inner glass sheet. Each test was repeated several times.

It is observed that these temperatures correspond to effective working temperatures of the oven which are somewhat higher by about 10 to 20%. For example in a real oven the effective temperature of the oven is 250° C. which corresponds to an inner glass sheet temperature of the window of 217° C. It has been found that with the window of the present invention the external temperature reduces by 20%. The results are shown in following Table III.

TABLE III

| Internal Temperature (°C.) | | External Temperature (°C.) | | Thermal Flux ($W/m^2$) | |
|---|---|---|---|---|---|
| TEST | AVERAGE | TEST | AVERAGE | TEST | AVERAGE |
| 98 | 98 | 46 | 48 | 240 | 260 |
| 98 | | 48 | | 266 | |
| 98 | | 48 | | 270 | |
| 97 | | 49 | | 267 | |
| 150 | 148 | 66 | 66 | 536 | 530 |
| 146 | | 66 | | 520 | |
| 148 | | 66 | | 530 | |
| 196 | 199 | 86 | 87 | 877 | 885 |
| 197 | | 87 | | 866 | |
| 203 | | 88 | | 913 | |

It is therefore evident that even under the most severe working conditions the temperature of the external surface of the outer glass sheet of the window (87° C.) is substantially less than conventional oven windows. With the use of a second external reflecting layer it is possible to reach even lower temperatures.

Eventual additions and/or modifications can be carried out by those skilled in the art with respect to the above described and illustrated preferred form of the domestic oven window according to the present invention without departure from the spirit and scope of the invention.

We claim:

1. An observation window comprising:

A. an outer glass sheet having an outer facing surface and an inner facing surface, the inner facing surface covered by a layer of material reflecting infra-red radiation and transmitting visible light and;

B. an inner glass sheet having an outer facing surface and an inner facing surface and;

C. a distancing wall the edges of which are peripherally attached to both the outer glass sheet and the inner glass sheet thus defining an enclosed volume and;

D. a glass pumping tubulation attached to the distancing wall and;

E. a rare-gas contained within the enclosed volume at a pressure of between 10 and 1000 mbar at 25° C.

2. An observation window of claim 1 in which the outer glass sheet is substantially planar.

3. An observation window of claim i in which the inner glass sheet is substantially planar.

4. An observation window of claim 1 in which the outer glass sheet is borosilicate glass.

5. An observation of claim 1 in which the inner glass sheet is borosilicate glass.

6. An observation of claim 1 in which the layer of reflecting material is a multilayer of metal oxides.

7. An observation window of claim 1 in which the outer facing surface of the inner glaSs sheet is covered by multilayers of metal oxides reflecting infra-red radiation and transmitting visible light.

8. An observation window of claim 1 in which the rare-gas is chose from the group comprising He, Ne, Ar, Kr and Xe.

9. An observation window comprising:

A. an outer glass sheet having an outer facing surface and an inner facing surface, the inner facing surface covered by a layer of material reflecting infra-red radiation and transmitting visible light and;

B. an inner glass sheet having an outer facing surface and an inner facing surface and;

C. a distancing wall the edges of which are peripherally attached to both the outer glass sheet and the inner glass sheet thus defining an enclosed volume and;

D. a glass pumping tubulation attached to the distancing wall and;

E. a rare-gas contained within the enclosed volume at a pressure of between 1 and 1000 mbar at 25° C. and;

F. a getter material within said enclosed volume.

10. An observation window comprising:

A. an outer glass sheet having an outer facing surface and an inner facing surface, the inner facing surface covered by a layer of material reflecting infra-red radiation and transmitting visible light and;

B. An inner glass sheet having an outer facing surface and an inner facing surface and;

C. a distancing wall the edges of which are peripherally attached to both the outer glass sheet and the inner glass sheet thus defining an enclosed volume and;

D. a glass pumping tubulation attached to the distancing wall and;

E. a rare-gas contained within the enclosed volume at a pressure of between 1 and 1000 mbar at 25° C. and;

F. a getter material within saiD enclosed volume;

in which the getter material is in the form of pills or powder pressure bonded to a metal support strip.

11. An observation window comprising:

A. an outer glass sheet having an outer facing surface and an inner facing surface, the inner facing surface covered by a layer of material reflecting infra-red radiation and transmitting visible light and;

B. an inner glass sheet having an outer facing surface and an inner facing surface and;

C. a distancing wall the edges of which are peripherally attached to both the outer glass sheet and the inner glass sheet thus defining an enclosed volume and;

D. a glass pumping tubulation attached to the distancing wall and;

E. a rare-gas contained within the enclosed volume at a pressure of between 1 and 1000 mbar at 25° C. and;

F. a getter material within said enclosed volume;

in which the getter material is chosen from the group consisting of;

(a) an alloy of zirconium and aluminum in which the weight % of aluminum is between 5 and 30;

(b) a partially sintered mixture of powdered graphite or zeolite with at least one metallic powder chosen from the group consisting of Zr, Ta, Hf, Nb, Ti, Th and U, the powder of graphite of zeolite being present up to a weight % of 30° %; based on the weight of the partially sintered mixture;

(c) a partially sintered mixture of:

(i) particulate Zr-Al comprising from 5 to 30 weight % of Al, remainder Zr, and (ii) at least one metallic powder chosen from the group consisting of Zr, Ta, Hf, Nb, Ti, Th and;

(d) a powdered alloy of Zr-V-Fe whose weight composition in weight % when plotted on a ternary composition diagram in weight % Zr, weight % V and weight % Fe lies within a polygon having as its corners the points defined by:

(i) 75% Zr - 20% V - 5% Fe (ii) 45% Zr - 20% V - 35% Fe (iii) 45% Zr - 50% V - 5% Fe.

12. An observation window in the door of a domestic oven comprising:

A. An outer borosilicate glass sheet having an outer facing surface and an inner facing surface, the inner facing surface covered by multilayers of metal oxides reflecting infra-red radiation and transmitting visible light and;

B. an inner borosilicate glass sheet having an outer facing surface and an inner facing surface and;

C. a borosilicate distancing wall the edges of which are peripherally attached to both the outer glass sheet and the inner glass sheet thus defining an enclosed volume and;

D. a sealed borosilicate glass pumping tubulation attached to the distancing wall and;

E. a rare-gas contained within the enclosed volume at a pressure of between 700 and 900 mbar at 25° C. and;

F. a getter material in the form of pills or powder pressure bonded to a metal support strip within said enclosed volume.

13. An observation window in the door of a domestic oven comprising:

A. a substantially planar outer borosilicate glass sheet having an outer facing surface and an inner facing surface, the inner facing surface covered by multilayers of metal oxides reflecting infrared radiation and transmitting visible light and;

B. a substantially planar inner borosilicate glass sheet having an outer facing surface and an inner facing surface, the outer facing surface covered by multilayers of metal oxides reflecting infrared radiation and transmitting visible light and;

C. a borosilicate distancing wall the edges of which are peripherally attached to both the outer glass sheet and the inner glass sheet thus defining an enclosed volume and;

D. a sealed borosilicate glass pumping tubulation attached to the distancing wall and; 'E. krypton gas contained within the enclosed volume at a pressure of between 700 and 900 mbar at 25° C. and;

F. a getter material in the form of pills or powder pressure bonded to a metal support strip within said enclosed volume chosen from the group consisting of;

(a) an alloy of zirconium and aluminium in which the weight % of aluminium is between 5 and 30%;

(b) a partially sintered mixture of powdered graphite or zeolite with at least one metallic powder chosen from the group comprising Zr, Ta, Hf, Nb, Ti, Th and U, the powder of graphite or zeolite being present up to a weight % of 30%; based on the weight of the partially sintered mixture;

(c) a partially sintered mixture of:

(i) particulate Zr-Al comprising from 5 to 30 weight % of Al, remainder Zr, and (ii) at least one metallic powder chosen from the group consisting of Zr, Ta, Hf, Nb, Ti, Th and U;

(d) a powdered alloy of Zr-V-Fe whose weight composition in weight % when plotted on a ternary composition diagram in weight % Zr, weight % V and weight % Fe lies within a polygon having as its corners the points defined by:

(i) 75% Zr - 20% V - 5% Fe (ii) 45% Zr - 20% V - 35% Fe (iii) 45% Zr - 50% V - b 5% Fe;

(e) a partially sintered mixture of:

(i) particles of at least one metal chosen from the group consisting of Ti and Zr, and (ii) a powder alloy Zr-V-Fe whose composition in weight % when plotted on a ternary composition diagram in weight % Zr, weight % V and weight % Fe lies within a polygon having as its corners the points defined by:

i - 75% Zr - B 20% V - 5% Fe ii - 45% Zr - 20% V - 35% Fe iii - 45% Zr - 50% V - 5% Fe.

wherein the outer glass sheet is parallel to the inner glass sheet and is spaced a distance therefrom;

wherein both glass sheets are transparent.

14. An oven comprising

I. An enclosure; and

II. A door providing access to the enclosure; and

III. Means for heating the enclosure; and

IV. An observation window within the door; said window comprising:

A. an outer glass sheet having an outer facing surface and an inner facing surface, the inner facing surface covered by a layer of material reflecting infra-red radiation and transmitting visible light and;

B. an inner glass sheet having an outer facing surface and an inner facing surface and;

C. a distancing wall the edges of which are peripherally attached to both the outer glass sheet and the inner glass sheet thus defining an enclosed volume and;

D. a glass pumping tubulation attached to the distancing wall and;

E. a rare-gas contained within the enclosed volume at a pressure of between 10 and 1000 mbar at 25° C.

* * * * *

UNITED STATES PATENT AND TRADEMARK OFFICE

CERTIFICATE OF CORRECTION

PATENT NO. : 4,898,147

DATED : Feb. 6, 1990

INVENTOR(S) : Doni et al.

It is certified that error appears in the above-identified patent and that said Letters Patent is hereby corrected as shown below:

Col. 6, Line 13, for "claim i" read --claim 1--.
Col. 6, Line 22, for "glaSs" read --glass--.
Col. 6, Line 26, for "chose" read --chosen--.
Col. 6, Line 61, for "saiD" read --said--.
Col. 7, Line 16, for "30;" read --30%;--.
Col. 7, Line 20, for "of" (second occurence) read --or--.
Col. 7, Line 21, for "30°%" read --30%--.

Col. 8, Line 4, omit the apostrophy (') and begin a new paragraph.
Col. 8, Line 33, for "b5%" read --5%--.
Col. 8, Line 41, for "B20%" read --20%--.

Signed and Sealed this

Eleventh Day of February, 1992

*Attest:*

HARRY F. MANBECK, JR.

*Attesting Officer*

*Commissioner of Patents and Trademarks*